US006026844A

United States Patent [19]

Laing et al.

[11] Patent Number: 6,026,844

[45] Date of Patent: Feb. 22, 2000

[54] DUAL RESERVOIR-BASED HOT WATER RECIRCULATION SYSTEM

[76] Inventors: Karsten Laing; Nikolaus J. Laing, both of 1253 La Jolla Rancho Rd., La Jolla, Calif. 92037

[21] Appl. No.: 09/314,689

[22] Filed: May 19, 1999

Related U.S. Application Data

[63] Continuation-in-part of application No. 09/020,349, Feb. 9, 1998, and a continuation-in-part of application No. 08/669,147, Jun. 24, 1996.

[30] Foreign Application Priority Data

May 20, 1998 [DE] Germany ..... 198 22 703

[51] Int. Cl.[7] ..... F16K 49/00

[52] U.S. Cl. ..... 137/337; 137/338; 137/340

[58] Field of Search ..... 137/337, 338, 137/340

[56] References Cited

U.S. PATENT DOCUMENTS

| | | | |
|---|---|---|---|
| 5,277,219 | 1/1994 | Lund | 137/337 |
| 5,339,859 | 8/1994 | Bowman | 137/337 |
| 5,351,712 | 10/1994 | Houlihan | 137/337 |

*Primary Examiner*—A. Michael Chambers
*Assistant Examiner*—Thomas L. McShane
*Attorney, Agent, or Firm*—Henri J.A. Charmasson; John D. Buchaca

[57] ABSTRACT

In a hot and cold water plumbing installation, a volume of hot water is first drawn from the hot water line and stored in an insulated reservoir. When the temperature of the water near the most distal location of the hot water line falls below a predetermined level, the contents of the insulated reservoir are reinjected back into that line to flush the cooled down water back into the water heater. A second reservoir is used between the water heater inlet and the cold water source to absorb the excess water resulting from the aforesaid reinjection and prevent hot water from being injected into the cold water line.

20 Claims, 2 Drawing Sheets

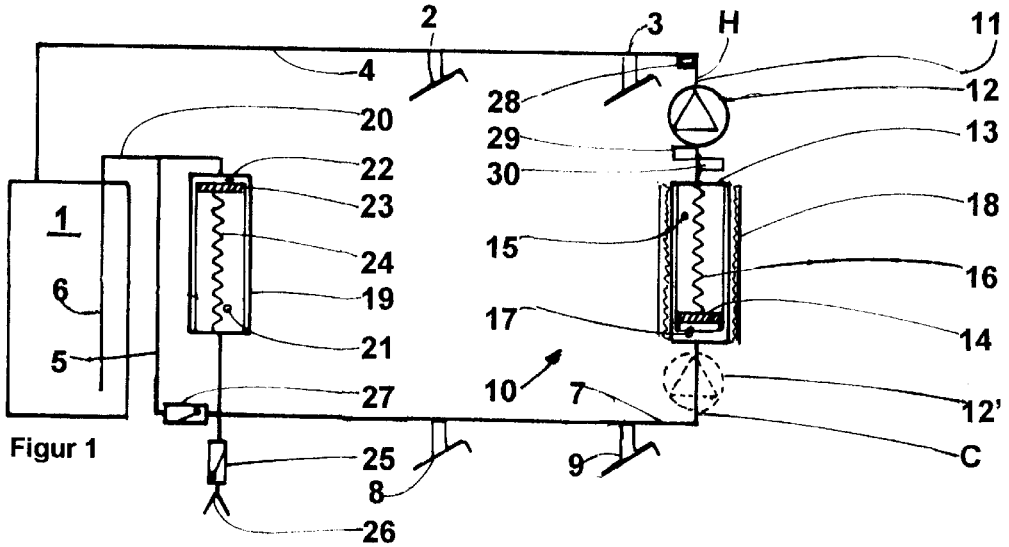
Figur 1
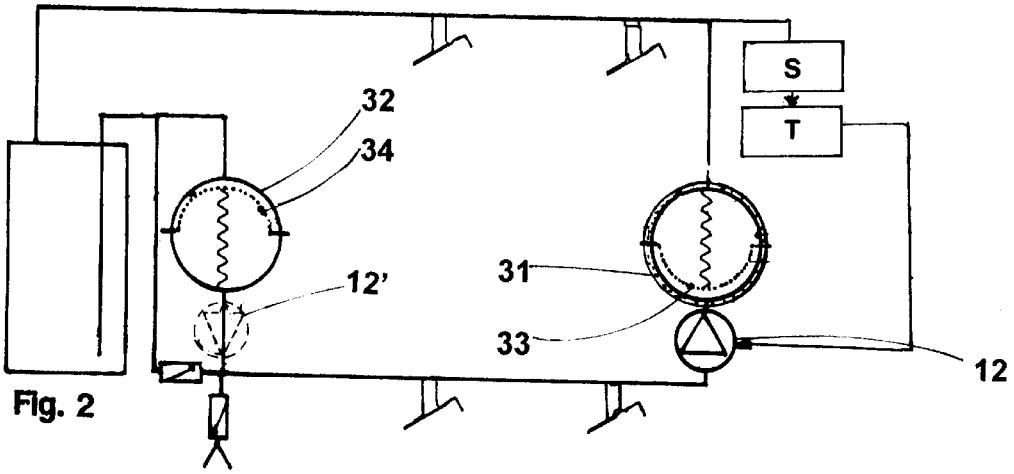
Fig. 2
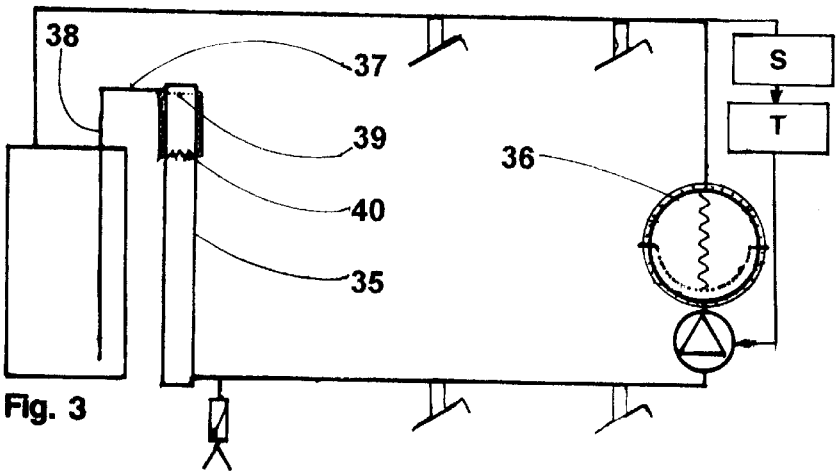
Fig. 3

DUAL RESERVOIR-BASED HOT WATER RECIRCULATION SYSTEM

PRIOR APPLICATION

This is a continuation-in-part of co-pending application Ser. No. 09/020,349 filed Feb. 9, 1998, a continuation-in-part of application Ser. No. 08/669,147, filed Jun. 24, 1996.

FIELD OF THE INVENTION

The invention relates to hot water distribution systems, and more specifically to recirculation pumps for assuring instantaneous hot water delivery from a hot water tap.

BACKGROUND OF THE INVENTION

Hot water recirculating systems are known in which the cooled down water content of the hot water distribution line is conveyed back into the hot water tank via a recirculation pipe as disclosed in U.S. Pat. No. 5,143,049 Laing. Modifying a standard water distribution network by installing a recirculation system requires additional piping which may be difficult to install. A different type of hot water recovery system is disclosed in U.S. Pat. Nos. 5,009,572 Imhoff et al., 5,143,049 Laing, and 5,277,219 Lund, in which a recirculation pump is switched on if the hot water temperature near the faucet drops below a predetermined level or as soon as a hot water faucet is opened. To economize the hot water usage the pump conveys the cooled-down content of the hot water distribution line back through the cold water distribution line into the water heater. Thus the cold water faucets in the distribution line receive warm water when the cooled-down water content between the water heater and the faucets has been pumped into the cold water distribution line.

The aforesaid U.S. Pat. Nos. 5,009,572 Imhoff et al.; 5,143,049 Laing et al.; and 5,277,219 Lund are incorporated into this specification by this reference.

The prior art systems that recirculate the cooled-down portion of the hot water distribution line directly through the cold water distribution line have several drawbacks. The most serious is the fact that the cold water distribution line is first filled with lukewarm, if not hot water. If cold water is needed right after a recirculation cycle, the user must wait several seconds for that heated water to be purged from the cold water distribution line.

The present inventions avoid these drawbacks.

SUMMARY OF THE INVENTION

The primary and secondary objects of the invention are to improve the operation of a hot and cold water system distribution, and to assure an immediate supply of hot water to a hot water faucet by draining any cooled down water in the hot water line into the water heater; and to prevent the drawing of lukewarm water when the cold water faucet is turned on.

These and other valuable objects are achieved by an improved plumbing network in which a volume of hot water at least equal to the capacity of the hot water line is drawn from that line from a point near the most distal of the hot water faucets, and is temporarily stored in an insulated, pressurized reservoir. When the temperature of the hot water line near that most distal faucet drops below an unacceptable preset level, the contents of the reservoir is forced back into the hot water line by a pump in order to flush the cooled down water back into the hot water heater.

The cold water source is protected against reflux from the system by a check valve in the main water supply line. The excess volume of water introduced into the system out of the reservoir is absorbed by a second balancing, pressurized reservoir connected to the water heater cold water inlet. The pressurization of the reservoir is provided by a compression spring acting against a movable septum within each reservoir, and by admitting water from each end of the distributing system into the respective reservoirs behind said septum.

In an alternate embodiment of the invention, the role of the compression springs is fulfilled by a second pump working in opposite direction to the first one.

BRIEF DESCRIPTION OF THE DRAWING

FIG. 1 is a diagram of the first preferred embodiment of the invention;

FIG. 2 is a diagram of a first alternate embodiment of the invention;

FIG. 3 is a diagram of a second alternate embodiment of the invention;

DESCRIPTION OF THE PREFERRED EMBODIMENTS OF THE INVENTION

Figure 4:
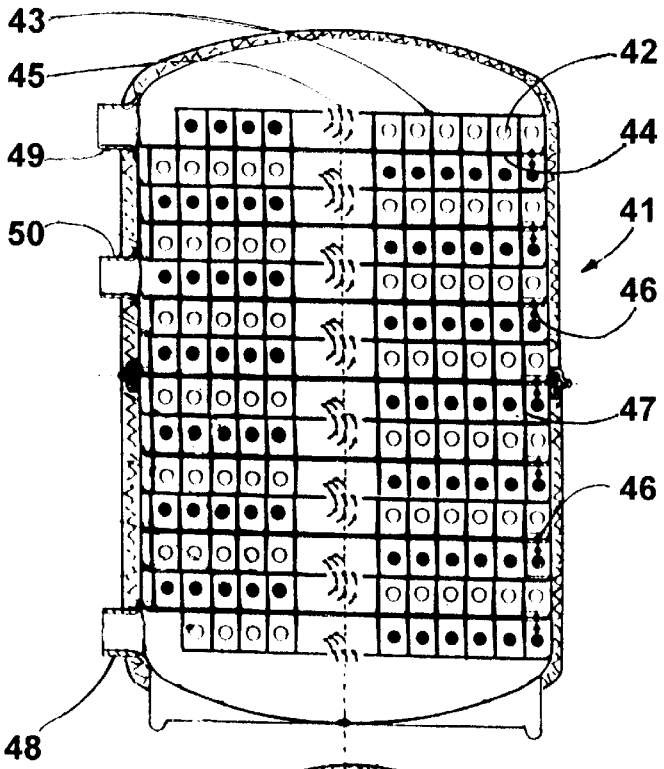
FIG. 4 is a longitudinal cross-sectional view of the reservoir used in connection with the third alternate embodiment of the invention.

Referring now to the drawing, there is shown in FIG. 1, a plumbing system in which hot water is delivered from a water heater 1 to a series of hot water faucets 2, 3 through a hot water line 4. Cold water is delivered through a first cold water line 5 and dip-tube 6 to the water heater 1, and through a second cold water line 7 to a series of cold water faucets 8, 9 respectively adjacent to the hot water faucets 2, 3. In order to maintain the hot temperature of the water drawable through the hot water faucets 2, 3, a recirculation circuit 10 is installed between point H on the hot water line 4 proximate the hot water faucet 3 most distal from the water heater 1, and point C on the cold water line 7 proximate the cold water faucet 9 associated with the latter hot water faucet 3. The recirculation circuit 10, in its basic configuration, consists essentially of a conduit 11 in series with a centrifugal pump 12 and an insulated first reservoir 13. That reservoir comprises two chambers separated by a movable septum, in this case, a piston 14. The first chamber 15 can be contracted by the movement of the piston, and is connected via pump 12 to point H on the hot water line. In that chamber, a compressed coil spring 15 resiliently biases the piston 14 against upward contracting movement. On the opposite side of the piston is an expandable chamber 17. This expandable chamber is connected to point C on the second cold water line. It should be noted that the pump 12 could alternately be positioned between the expandable chamber 17 and point C as shown in dotted line on the drawing. The reservoir 13 is protected against rapid loss of heat by an insulating blanket 18.

A similar reservoir 19 is positioned between the dip tube inlet 20 of the water heater and the second cold water line 7. In this case, the contractable chamber 21 is connected to the second water line 7, and the expandable chamber 22, located behind piston 23 is connected to the cold water inlet 20 of the water heater. The compressible coil spring 24 is biased to resiliently oppose downward movement of the piston 23, i.e., against the contraction of the contractable chamber 21 and the expansion of the expandable chamber 22. A first check valve 25 is interposed between the plumbing system and the cold water source 26 in order to prevent back flow toward said water source. A second check valve 27 is placed on the first cold water line 5 and oriented to prevent back flow from the cold water inlet 20 of the water heater into second cold water line 7. In other words, this check valve is mounted in parallel with the second reservoir 19 between the inlet to the cold water heater and the second cold water line 7. It should be noted that the moving septi which contract and expand the respective chambers in the two reservoirs could be implemented by other means such as flexible membranes, or a combination of flexible membranes and rigid elements.

The pump 12 is activated when a temperature sensor 28 which monitors the temperature level at point H on the hot water line detects a predetermined and intolerable drop of the water temperature proximate the hot water faucet 3. The pump is kept active until the first contractable chamber 15 in the insulated first reservoir has been emptied. The time of operation can be determined either by a timer 29 or a switch 30 in the contractable chamber 15 detecting the maximum excursion point of the piston 14 into that chamber. The capacity of the contractable chambers 15, 21 is equal to at least twice the volume of the hot water line 4.

The system is primed by admitting hot water into the first contractable chamber 15 of the first reservoir. This may be done by opening the hot water faucet 3 proximate point H and activating the pump in order to evacuate any cooled down water in the reservoir through that faucet. When the pump is shut down and the hot water faucet 3 is turned off, the expansion of the spring 16 causes a downward movement of the piston and the corresponding expansion of the first contractable chamber 15. As a result, hot water is drawn from the hot water line 4 through the inactive pump into the now decontracting first chamber 15. The water now stored in the first reservoir 13 will be kept hot by the insulating blanket 18. When the temperature sensor 28 detects the predetermined temperature in the water proximate point H, the pump is activated and the hot water contents of the first contractable chamber 15 is pumped into the hot water line 4. The cooled down contents of that line is flushed back into the water heater. A corresponding amount of water is pushed through the dip stick 6 and cold water inlet 20 of the water heater into the expandable chamber 22 of the second reservoir 19. Under the pressure of this reflux of water, the piston contracts chamber 21 of the second reservoir. The water in that contractable chamber flows through the second cold water line 7 into the expandable chamber 17 of the first reservoir. The main function of the second reservoir 19 is to prevent any hot water pushed through the dip stick 7 from being dumped into the second cold water line. The first cold water line 5 provides a path to replenish the water heater any time water is drawn through one of the hot water faucets 2, 3. It should be understood that the amount of expansion available in the expandable chamber 22 of the second reservoir 19 be at least equal to twice the volume of contraction experienced by the contractable chamber 15 of the first reservoir 13.

In the alternate embodiment illustrated in FIG. 2, the first reservoir 31 and second reservoir 32 have spherical shapes, and their respective movable septums are implemented by flexible membranes 33, 34. A second alternate location 35 for the pump 12 is illustrated in dotted line.

In the third alternate embodiment illustrated in FIG. 3, the second reservoir 35 has an elongated shape and a capacity which is at least twice the capacity of the first reservoir 36. Below the upper inlet 37 of that second reservoir which is connected to the dip stick inlet 38 of the water heater, is a fluid equalizing mesh 38 that prevents the incoming hot water jet from the water heater from penetrating deeply into the cold water of the reservoir. The separation zone 40 between the cold water below and the warm water above flushed back from the water heater performs the same function as the membranes and pistons of the earlier described embodiments. Since the second reservoir 35 is capable of absorbing and retaining more water than may be flushed out of the contractable chamber of the first reservoir 36, there is no danger that any water flushed back out of the water heater into the second reservoir can ever reach the cold water line. Moreover, since there is no solid barrier between the upper and lower regions of the second reservoir, there is no need for a direct line from the water source to the cold water inlet 38 of the water heater.

Figure 5:
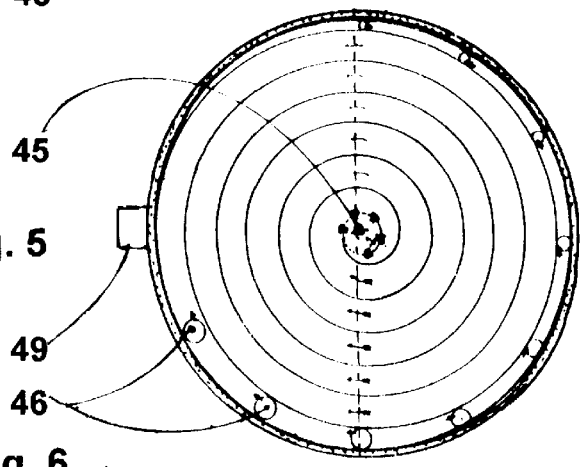
FIG. 5 is a cross-sectional view taken along lines 5—5 of FIG. 4.

The reservoir illustrated in FIGS. 4 and 5 can be used to replace the second reservoir in the alternate third embodiment described above. The reservoir 41 is sub-divided into a plurality of layers 42 delineated by horizontal septi 43, 44. In each layer, the upper septum has a central aperture 45 giving access to the layer immediately above it. The lower septum 44 has marginal or peripheral apertures 46 giving access to the layer immediately below. In each layer a spiraling vertical septum 47 creates a long, circuitous path between a peripheral inlet aperture 46 and the central aperture 45. Thus, water admitted through the bottom inlet 48 of the reservoir must follow a long and complex path before it reaches the upper outlet 49 connected to the uppermost layer 43. An intermediary inlet/outlet 50 is also provided.

Figure 6:
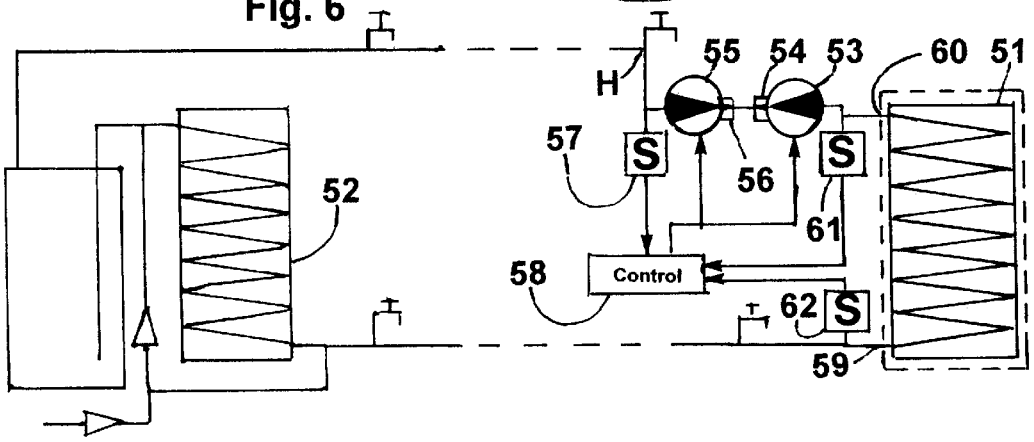
FIG. 6 is a diagram of a third alternate embodiment of the invention.

In the system illustrated in FIG. 6, the insulated first reservoir 51 and the second reservoir 52 are of the type illustrated in FIGS. 4 and 5. A first pump 53 used to draw hot water from the insulated first reservoir 51 has a built in check valve 54 that allows water to flow from its inlet to its outlet only when that pump is activated. Such a pump is disclosed in my application Ser. No. 08/669,167 filed Jun. 24, 1996, now abandoned. It should be noted that the outlet check valve that prevents back flow in the patented pump must not be present in the instant embodiment. A second similar pump 55 with its built-in check valve 56 is mounted in series with and in opposition to the first pump 53. A first sensor 57 is used to monitor the temperature of the water near the most distal point H of the hot water line. The output of that sensor is used by a control unit 58 to activate the first pump 53. The activation of the first pump causes the contents of the insulated first reservoir 51 to be injected into the hot water line through the inactive second pump 55. As compensating cold water is admitted through the lower inlet 57 into the insulated first reservoir, it moves up that reservoir, out the upper inlet 58. When temperature sensor 61 located near that inlet detects a drop in the water temperature, control unit 58 deactivates the first pump 53 and activates the second pump 54. At this point, hot water flows from the hot water line into the insulated first reservoir 51 through the inactive first pump 53. When a temperature sensor 62 proximate the lower inlet 59 of that reservoir detects a rise in temperature, control unit 58 deactivates the second pump 55. Hot water now fills the insulated first reservoir 51. That water is ready to be reinjected into the hot water line through a new operating cycle as soon as the water cools down at the end of the hot water line. The second reservoir 52 absorbs any hot water that may be flushed out of the water heater through its dip stick, and prevents it from reaching the cold water line.

It should be noted that any cold water that may enter the second reservoir 51 through the lower inlet 59 during the first pump operating cycle, never reaches the hot water line, but is flushed back into the cold water line during the second pump operating cycle.

Any drop of pressure in the hot or cold water lines due to the opening of a faucet cannot draw any water out of the first reservoir as long as the pumps are both inactive. Their respective built-in valves 54, 56 prevent any leakage in either direction during periods of pump inactivity.

While the preferred embodiments of the invention have been described, modifications can be made and other embodiments may be devised without departing from the spirit of the invention and the scope of the appended claims.

What is claimed is:

1. In a hot and cold water distribution system wherein hot water having a cold water inlet and a hot water outlet is distally delivered through a hot water line from a water heater to at least one hot water faucet, and cold water is delivered through a first cold water line to said water heater and through a second cold water line to at least one cold water faucet proximate said hot water faucet, an improvement for maintaining high temperature in the water drawable through said hot water faucet, said improvement comprising:

means for storing a volume of hot water drawn from said hot water line;

means for injecting said stored volume back into said hot water line when water temperature in said hot water line drops down to a preset level; and means for storing a compensating amount of water from said water heater as said volume is injected into said hot water line; and means for returning said amount back into said water heater as said volume is drawn from said hot water line.

2. The improvement of claim 1, wherein said means for storing a volume of hot water comprise:

an insulated reservoir;

means for drawing hot water from said hot water line into said reservoir; and wherein said means for storing a compensating amount of water comprise:

a second reservoir and means for drawing water from said water heater into said reservoir.

3. The improvement of claim 2, wherein said means for storing further comprise:

means for drawing said hot water from a point on said hot water line most distal from said water heater; and wherein said insulated reservoir and said second reservoir have commensurate capacities equal to at least twice the capacity of said hot water line.

4. The improvement of claim 3, wherein said means for drawing said volume comprise:

said insulated reservoir having a first contractable chamber;

means for contracting said first contractable chamber; and means for resiliently opposing contration of said first contractable chamber.

5. The improvement of claim 4, wherein said means for returning said amount comprise:

said second reservoir having a second contractable chamber;

means for contracting said second contractable chamber; and means for resiliently opposing contraction of said second contratable chamber.

6. The improvement of claim 5, wherein each of said means for contracting comprise:

a movable first septum in each of said reservoirs; and means for moving said first septum against said means for resiliently opposing.

7. The improvement of claim 6, wherein said means for injecting said stored volume of hot water into said hot water line comprise a pump having a suction inlet connected to said first contractable chamber of said insulated reservoir, and a pressure outlet connected to said distal point of the hot water line.

8. The improvement of claim 7, wherein said means for moving the septum in said second reservoir comprise:

said second reservoir having an first expandable chamber delineated by said second septum; and means for admitting water from said water heater into said first expandable chamber.

9. The improvement of claim 8, wherein said means for moving the septum in said first insulated reservoir comprise:

said insulated reservoir having a second expandable chamber delineated by said second septum; and means for admitting cold water from said second water line into said second contractable chamber.

10. The improvement of claim 4, wherein said second reservoir comprises a vertically elongated vessel having a first port in an upper region and a second port in a lower region, said second reservoir having a capacity substantially greater than said first reservoir;

said first port being connected to the cold water inlet of said water heater, and said second port being connected to said second cold water line.

11. The improvement of claim 10, wherein said means for contracting comprise:

a movable septum in said first reservoir; and means for moving said septum against said means for resiliently opposing.

12. The improvement of claim 11, wherein said means for injecting said stored volume of hot water into said water heater comprise a pump mounted in series with one of said reservoirs.

13. The improvement of claim 12, wherein said means for moving the septum in said first insulated reservoir comprise:

said insulated reservoir having a second expandable chamber delineated by said second septum; and means for admitting cold water from said second water line into said second contractable chamber.

14. The improvement of claim 3, wherein said means for drawing said volume comprise:

said insulated reservoir comprising a circuitous path having a first port at a upper end, and a second port at a lower end;

means for connecting said first port to said most distal point; and means for connecting said second port to said second cold water line.

15. The improvement of claim 14, wherein said means for returning said amount comprise:

said second reservoir comprising a circuitous path having a first opening at a upper end and a second opening at a lower end;

means for connecting said first opening to said cold water inlet; and means for connecting said second opening to said second cold water line.

16. The improvement of claim 15, wherein said means for injecting said stored volume of hot water into said hot water line comprise:

a first pump having a suction inlet connected to said first port of said insulated reservoir, and a pressure outlet, and means for connecting said pressure outlet to the distal point of said hot water line; and wherein said first pump comprises a valve means for preventing flow through said pump when said pump is not activated.

17. The improvement of claim 16, wherein said means for returning said amount further comprise:

a second pump mounted in series with and in opposite direction to said first pump.

18. The improvement of claim 7, wherein said means for injecting further comprise:

means for monitoring water temperature proximate said most distal point; and means for activating said pump when said temperature drops below a preset level.

19. The improvement of claim 16, wherein said means for injecting further comprise:

means for monitoring water temperature proximate said most distal point; and means for activating said pump when said temperature drops below a preset level.

20. The improvement of claim 12, wherein said means for injecting further comprise:

means for monitoring water temperature proximate said most distal point; and means for activating said pump when said temperature drops below a preset level.

* * * * *

UNITED STATES PATENT AND TRADEMARK OFFICE

CERTIFICATE OF CORRECTION

PATENT NO. : 6,026,844

DATED : February 22, 2000

INVENTOR(S) : KARSTEN LAING & NICHOLAUS J. LAING

It is certified that error appears in the above-indentified patent and that said Letters Patent is hereby corrected as shown below:

In column 2, line 52: replace, "spring 15" with --spring 16--.

In column 3, line 64: delete "35".

In column 4, line 4: replace "mesh 38" with --mesh 39--.

In column 4, line 19: replace "second" with --first--.

In column 4, line 52: replace "57" with --59--.

In column 4, line 56: replace "54" with --55--.

In column 5, line 2: replace "second" with --first--.

In column 5, line 17: delete "having a cold water inlet and a hot water outlet".

Signed and Sealed this

Tenth Day of April, 2001

*Attest:*

Nicholas P. Godici

NICHOLAS P. GODICI

*Attesting Officer*

*Acting Director of the United States Patent and Trademark Office*